US006901909B2

(12) United States Patent
Kajihara et al.

(10) Patent No.: US 6,901,909 B2
(45) Date of Patent: Jun. 7, 2005

(54) CENTRIFUGAL GOVERNOR FOR HORIZONTAL DIESEL ENGINES

(75) Inventors: Takahiro Kajihara, Sakai (JP); Shinkichi Iwasaki, Sakai (JP)

(73) Assignee: Kubota Corporation, Osaka (JP)

( * ) Notice: Subject to any disclaimer, the term of this patent is extended or adjusted under 35 U.S.C. 154(b) by 67 days.

(21) Appl. No.: 10/663,150

(22) Filed: Sep. 15, 2003

(65) Prior Publication Data

US 2005/0056252 A1 Mar. 17, 2005

(51) Int. Cl.[7] ..... F02D 31/00
(52) U.S. Cl. ..... 123/364; 123/374
(58) Field of Search ..... 123/364, 373, 123/374; 73/510, 512, 513

(56) References Cited

U.S. PATENT DOCUMENTS

| | | | | |
|---|---|---|---|---|
| 4,367,709 A | * | 1/1983 | Codrington | 123/339.29 |
| 4,397,277 A | * | 8/1983 | Takahashi | 123/373 |
| 4,463,720 A | * | 8/1984 | Ritter | 123/364 |
| 5,325,831 A | * | 7/1994 | Handa | 123/373 |

FOREIGN PATENT DOCUMENTS

| | | |
|---|---|---|
| JP | 57-51134 | 9/1955 |
| JP | 60-28236 | 2/1985 |
| JP | 60-105837 | 7/1985 |
| JP | 62-294726 | 12/1987 |

* cited by examiner

*Primary Examiner*—Mahmoud Gimie
(74) *Attorney, Agent, or Firm*—Akin Gump Strauss Hauer & Feld, LLP

(57) ABSTRACT

The centrifugal governor ensures that the governor lever (3) can apply a synthesized tensile force (STF) of the tensile forces (GS) of the main spring (4) and the tensile force (IS) of the idling spring (5) to the fuel adjuster (2) of the fuel pump (1) so as to increase the supply of fuel, and cause the governor weight (6) to decrease the fuel amount by pushing down the fuel adjuster (2), so that a disequilibrium between the synthetic tensile force (STF) of the two springs (4), (5) and the governor force (GF) is utilized for increasing or decreasing the supply of fuel through the operation of the fuel adjuster (2), and that the idling spring (5) which is constituted as a tension coiled spring spring-biases the governor lever (3) in the direction of increasing the supply of the fuel both in the non-load set and in the low-load set (LL), and negates the spring-biasing both in the high-load set (LH) and in the full-load set (4/4).

6 Claims, 7 Drawing Sheets

CENTRIFUGAL GOVERNOR FOR HORIZONTAL DIESEL ENGINES

TECHNICAL FIELD

The present invention relates to a centrifugal governor especially adapted for the horizontal diesel engines, and more particularly, to improvements upon the centrifugal governor incorporated in the horizontal diesel engines.

BACKGROUND ART

It is common practice to employ any device for keeping constant engine speed irrespective of the load the engine carries. The simplest device is a flywheel. However, it is not suitable for adjusting the fuel supply to the engine to counterbalance a disequilibrium between the generated power and the consumed power. To conduct an effective counterbalance, a governor has been devised. There are many types of governors, and a typical example is a centrifugal governor. The present invention is directed toward improvements upon a centrifugal governor, especially used for the horizontal diesel engines.

Referring to FIG. 7(A), which diagrammatically illustrates the internal construction of a conventional centrifugal governor, particularly an arrangement of levers 3, 31, 32, and 33. The illustrated centrifugal governor is a water-cooled system. An idling spring 5 is coupled to a governor lever 3 such that it can be spring-biased to cover a full range from the non-load (0/4) up to the full-road (4/4). This will become clearer from the graph of FIG. 7(B), which indicates variations in the tensile force of the idling spring. More specifically, the idling spring 5 is spring-biased to shift the governor lever 3 to increase the supply of fuel (in the R direction); that is, from the non-load set (0/4) to the full-load set (4/4).

However, the conventional centrifugal governor has the following disadvantage:

In a low-load set (LL) the governor can maintain a constant running speed, and in a high-load set (LH) it can minimize variations in the rated running speed of the engine, and increase its rising speed as a load increases. However, these two advantageous functions cannot be obtained at the same time, but they are in the relationship of "one or the other".

More specifically, as indicated in FIG. 7(B), to ensure a constant running speed of the engine in the low-load set (LL) the idling spring 5 must be adjusted to a required tensile force variation rate θ 1. The tensile force (ISI) of the idling spring 5 varies from the non-load set (0/4) to the full-load set (4/4), wherein the variation rate is depicted in a diagonally upward straight line as shown in FIG. 7B. As a result, the tensile force variation width (ISF1) tends to have a large value in contrast to the tensile force variation rate θ 1.

By referring to FIG. 5(B), a state of equibrium will be described, wherein the state of equibrium is shown in dotted line drawn between the synthesized tensile force (STF1) of the tensile force (IS1) of the idling spring 5 and the tensile force (GS1) of the main spring 4 is depicted in a diagonally upward straight line. As shown in FIG. 5(C), the governor force (GF) of the governor weight 6 is brought into equilibrium with the running speed (rpm) of the engine. As a result, as shown in dotted line in FIG. 5D, the governor characteristics for controlling the running speed against a load becomes linear. Because of this linear continuous state of equilibrium, the conventional centrifugal governor can neither minimize the variation rate of the rated running speed in the high-load set (LH) nor increase the rising speed when a load increases.

Therefore, an object of the present invention is to improve the conventional centrifugal governor, and is to provide a centrifugal governor that can maintain a constant running speed in the low-load set (LL), and can minimize the variation rate of the rated running speed in the high-load set (LH), and also can increase its rising speed when a load is stepped up, wherein these two advantageous functions can be equally achieved, not one or the other like the conventional centrifugal governors.

Another object of the present invention is to provide a centrifugal governor having a simplified and durable structure under which the above-mentioned double advantageous functions are equally achieved.

A further object of the present invention is to provide a centrifugal governor which, not only in the low-load set (LL) but also in the middle high-load set (LMH), the above-mentioned advantageous functions are equally achieved, not one or the other like the conventional centrifugal governors.

A still further object of the present invention is to provide a centrifugal governor whose idling spring operates with the minimum loss of its tensile force by simplifying the mechanical integration in the joint of the idling spring to the governor lever.

SUMMARY OF THE INVENTION

According to the present invention, the centrifugal governor used in the horizontal diesel engines includes a cylinder block including a cylinder transversely arranged and a crankshaft arranged in a plane perpendicular to the cylinder, a gear case provided in front of the cylinder block, a fuel pump housed in the gear case toward the cylinder, the fuel pump including a fuel adjuster, a governor weight located toward the crankshaft, a governor lever provided between the governor weight and the fuel pump, wherein the governor lever includes a weight-side lever and a spring-side lever, and a pivot about which the lever rotates in a horizontal plane, a spring supporter of letter-T form extends in the anterior-posterior direction from a middle part of the governor lever, a speed-adjusting lever provided nearer the fuel pump than the spring supporter, in such a manner as to enable the governor lever to rotate in a horizontal plane, a main spring fixed to the speed-adjusting lever at one end and to the spring supporter at the other end, and an idling spring fixed to the governor lever at one end, and to the front wall of the gear case at the other end, characterized in one aspect in that:

(1) the governor lever, when operated, applies a synthesized tensile force (STF) of the tensile forces (GS) of the main spring and the tensile force (IS) of the idling spring to the fuel adjuster of the fuel pump so as to increase the supply of fuel to the engine, and cause the governor weight to decrease the supply of fuel by pushing down the fuel adjuster, so that a disequilibrium between the synthetic tensile force (STF) of the two springs and the governor force (GF) is utilized for increasing or decreasing the supply of fuel through the operation of the fuel adjuster; and (2) the idling spring is constituted as a tension coiled spring and the idling spring spring-biases the governor lever in the direction of increasing the supply of the fuel both in the non-load set and in the low-load set (LL), and negates the spring-biasing both in the high-load set (LH) and in the full-load set (4/4).

According to another aspect of the present invention, the centrifugal governor allows the idling spring to spring-bias the governor lever in the direction of increasing the supply of fuel in the middle low load (LML), and negates the spring-biasing in the middle high-load set (LMH).

According to a further aspect of the present invention, the idling spring used in the centrifugal governor is constituted as a tension coiled spring having a hook engaged with a slot produced in the governor lever in such a manner that the hook is slidable in the slot in the direction in which the supply of fuel is increased.

According to a still further aspect of the present invention, the idling spring used in the centrifugal governor is constituted as a tension coiled spring having a hook engaged with a pin erected on the governor lever in such a manner that the hook is slidable along the pin in either of the directions in which the supply of fuel is increased or decreased.

BRIEF DESCRIPTION OF THE DRAWINGS

FIG. 1 is generally a diagrammatic view showing an embodiment of the present invention, wherein FIG. 1A is a plan view on an enlarged scale illustrating a main portion of the centrifugal governor of the present invention; FIG. 1B is a cross-section taken along the B—B line in FIG. 1A; FIG. 1C is a cross-section taken along the C—C line in FIG. 1C, and FIG. 1D is a variation characteristics curve of the idling spring;

FIG. 4 is generally a diagrammatic view illustrating the mechanism of the centrifugal governor of the present invention, wherein FIG. 4A is a plan view, FIG. 4B is a front view, FIG. 4C is a plan view of the lever of the spring of the governor lever, and FIG. 4D is a plan view of the lever of the governor weight;

FIG. 5 is generally a diagrammatic view illustrating the mechanism of the fuel control wherein FIG. 5A is a diagrammatic view illustrating the fuel control mechanism, FIG. 5B is a diagram illustrating variations in the tensile forces of the main spring and idling spring, FIG. 5C is a diagram illustrating variations in the governor force of the governor weight, and FIG. 5D is a diagram illustrating variations in the governor force of the governor weight;

FIG. 6 is generally a diagrammatic view showing another embodiment of the present invention, wherein FIG. 6A is a plan view on an enlarged scale showing a main portion of the centrifugal governor, FIG. 6B is a cross-section taken along the B—B line in FIG. 6A; FIG. 6C is a cross-section take along the C—C line in FIG. 6A, and FIG. 6D is a curve depicting variation characteristics in the tensile force of the idling spring; and FIG. 7 is generally a diagrammatic view of the conventional centrifugal governor, corresponding to FIG. 1A, wherein FIG. 7A is a plan view on an enlarged scale illustrating a main portion of the conventional centrifugal governor.

DETAILED DESCRIPTION OF THE PREFERRED EMBODIMENTS

Referring to FIGS. 1 to 5, the present invention will be more particularly described by way of example:

As described above the centrifugal governor of the present invention is basically identical in structure to the conventional centrifugal governor. As mentioned in the beginning, the centrifugal governor of the present invention is adapted for being incorporated in the water-cooled horizontal diesel engine.

Figure 1:
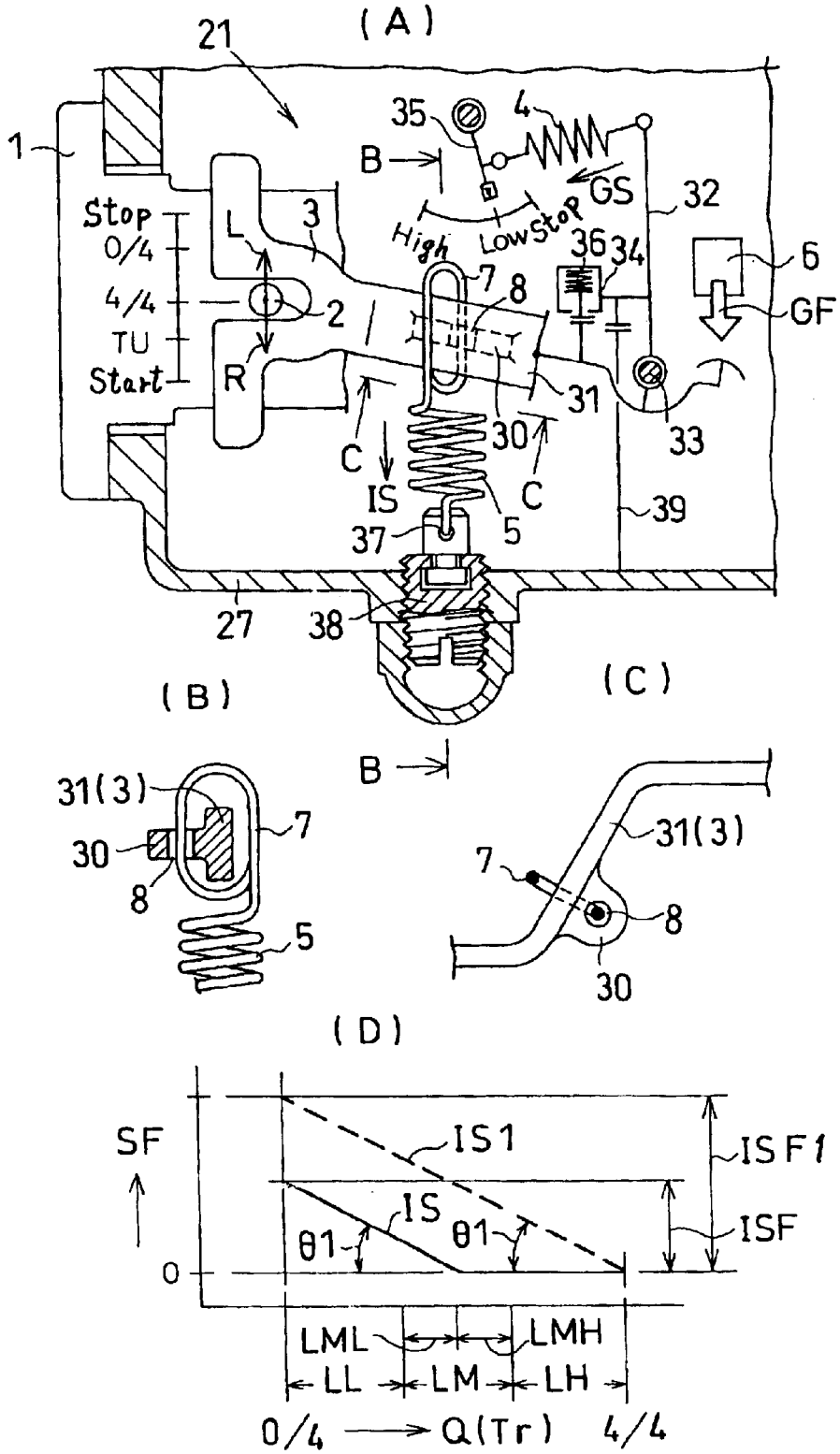
Figure 2:
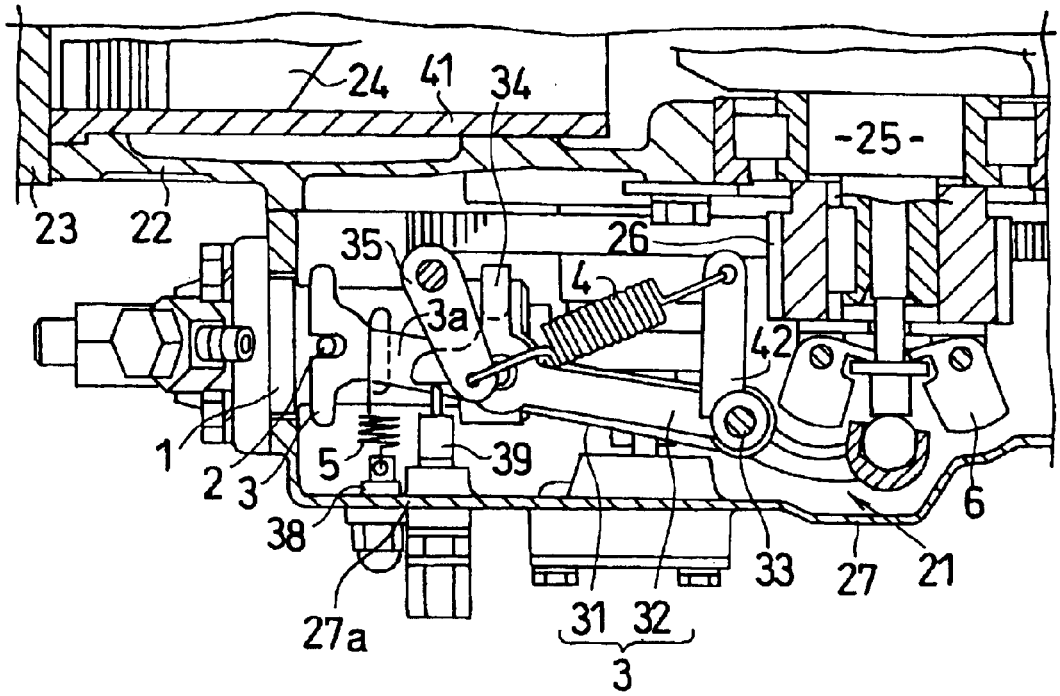
FIG. 2 is a cross-sectional plan view of the governor shown in FIG. 1; wherein, the left-to-right direction in the paper is referred to as "transverse", and the down-to-up direction is as "anterior-posterior direction"
Figure 3:
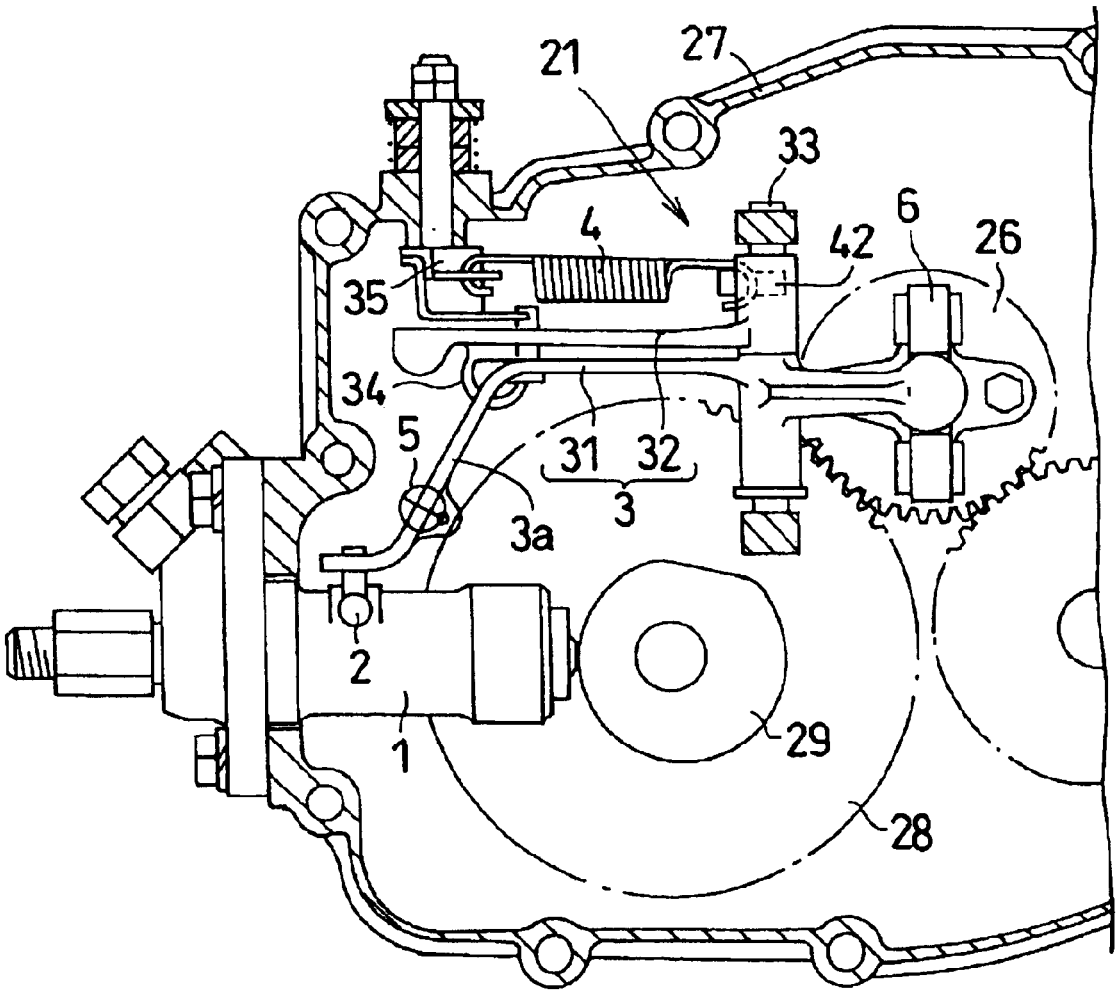
FIG. 3 is a vertical cross-section of the governor shown in FIG. 1.
Figure 4:
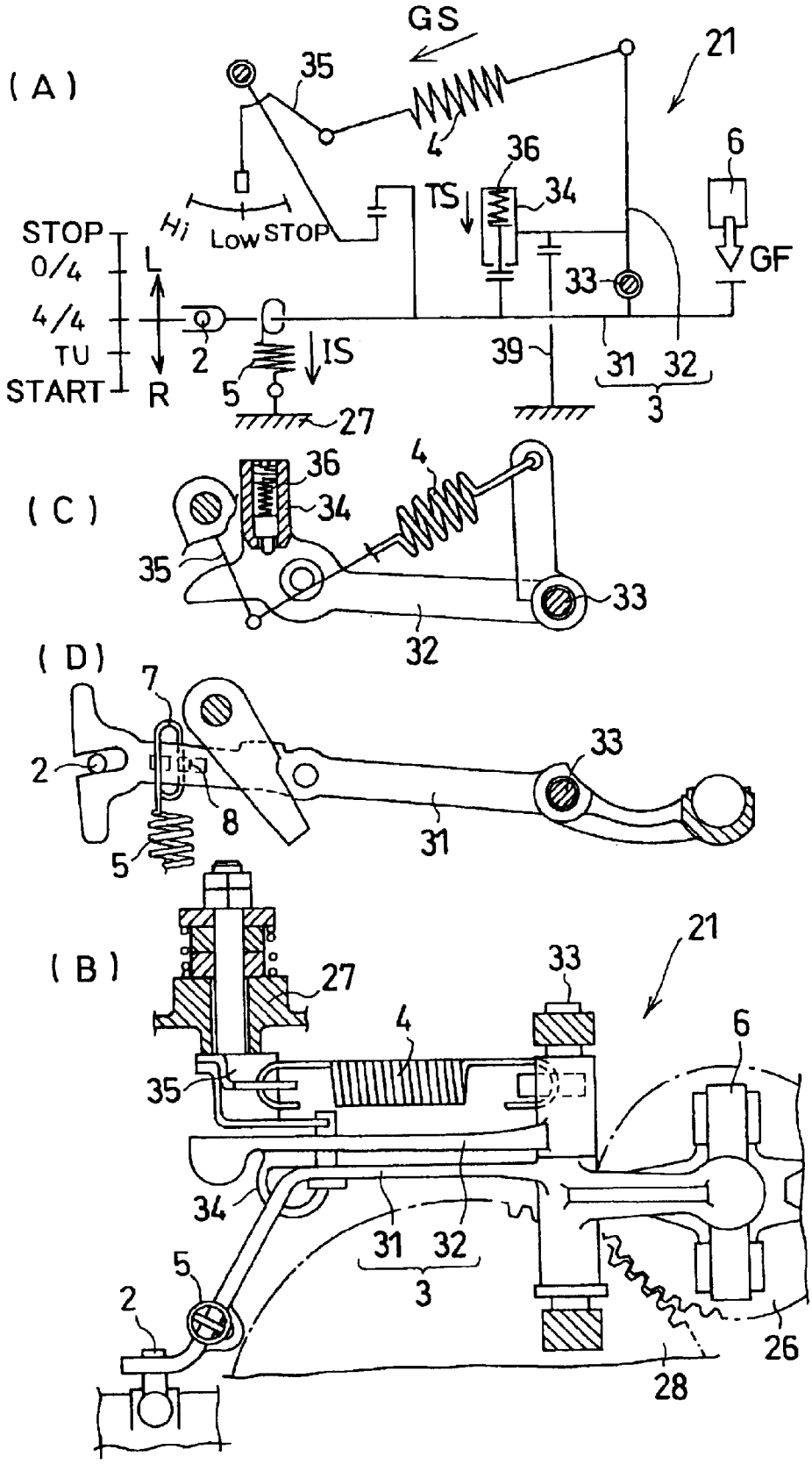
Figure 5:
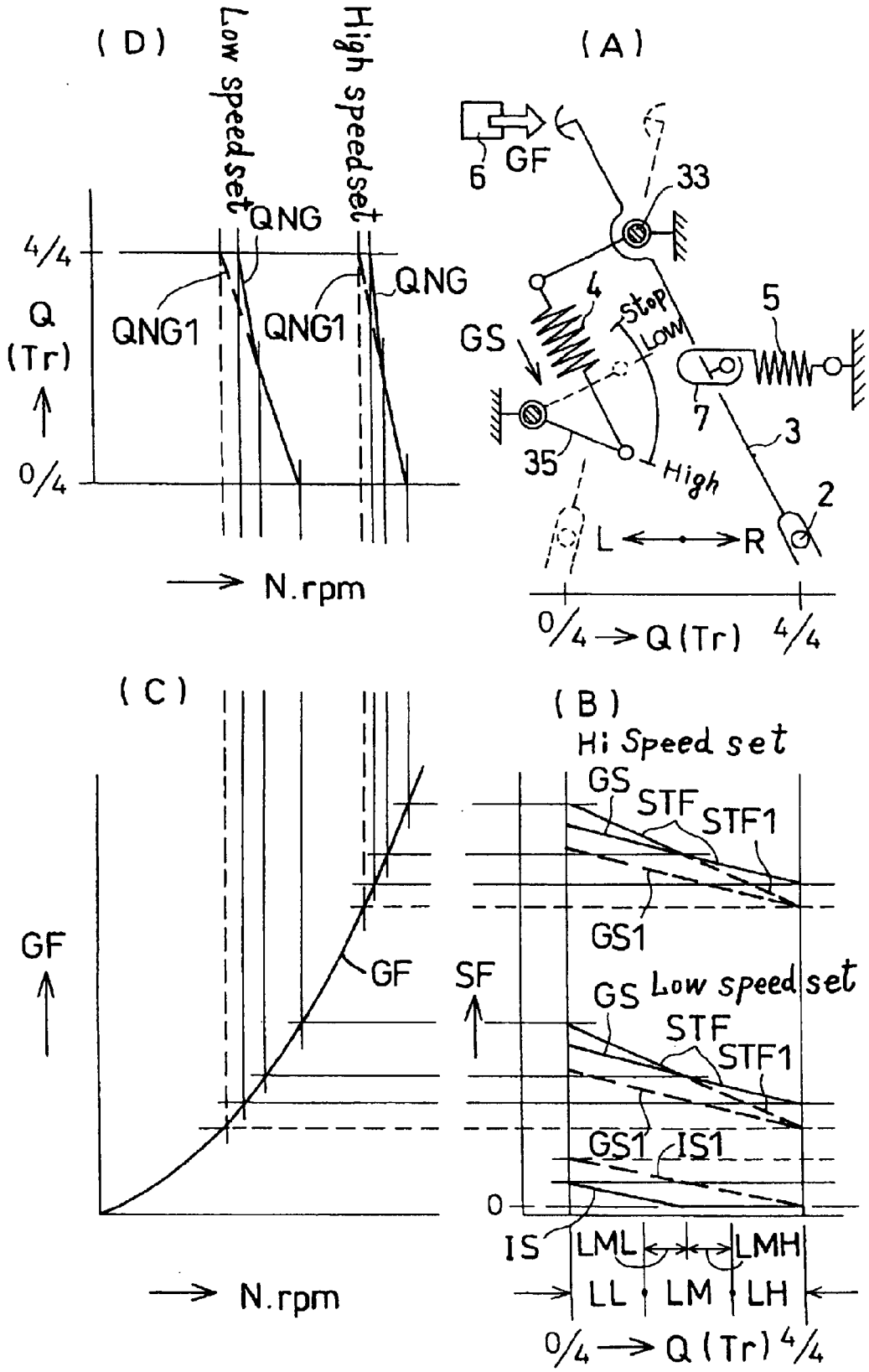
Figure 6:
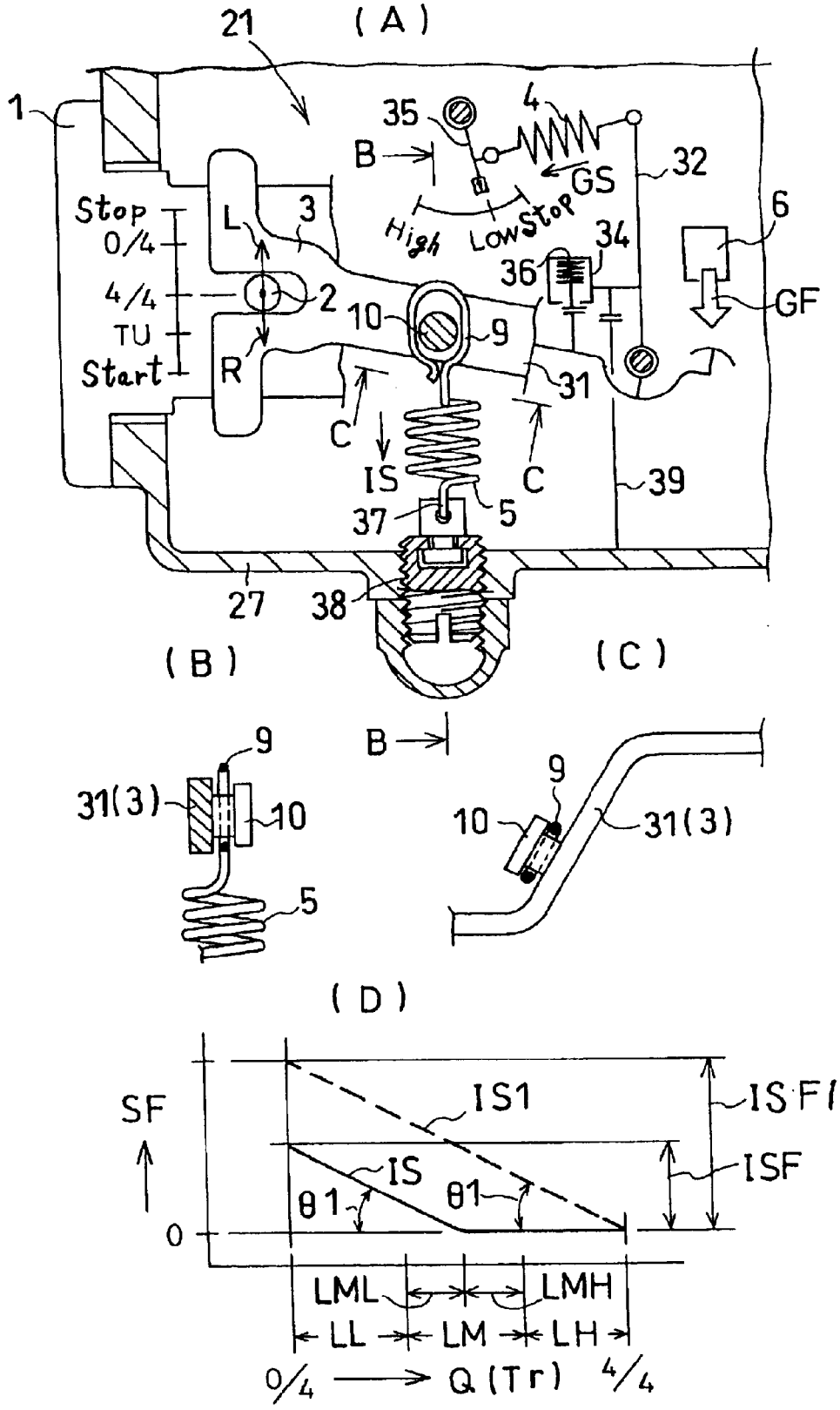
Figure 7:
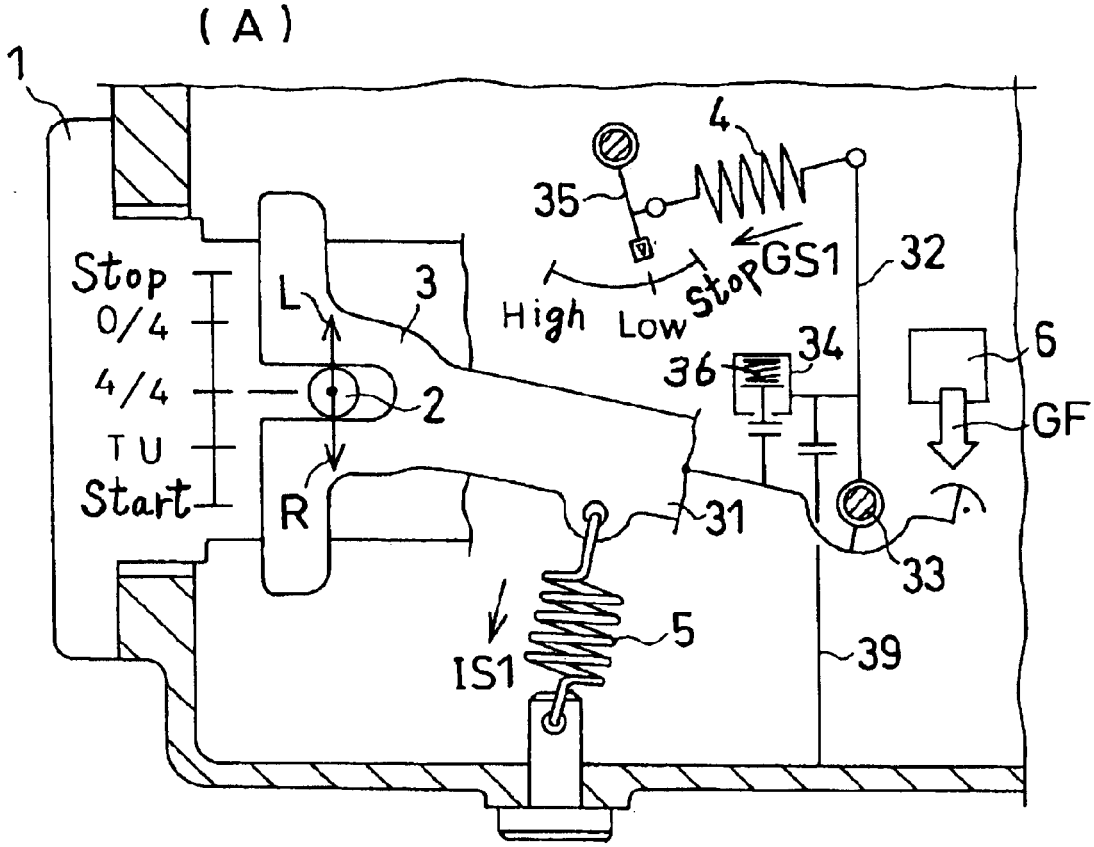
Figure 7:
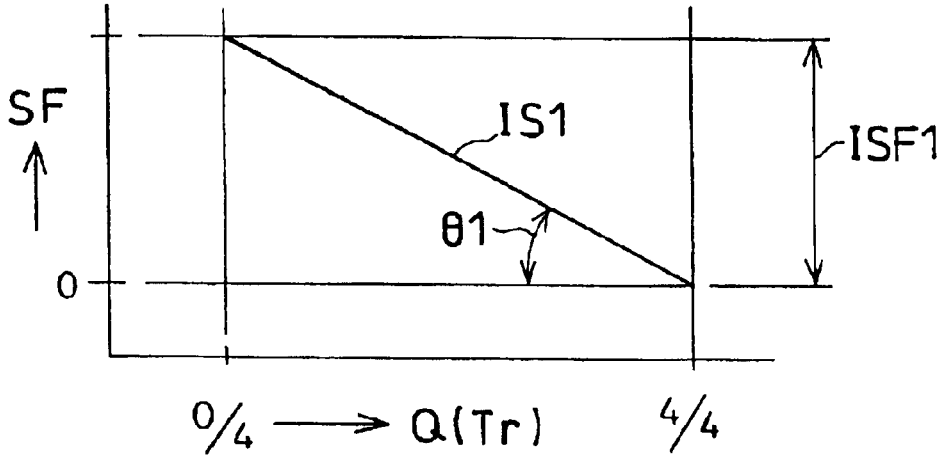

More specifically, as shown in FIG. 2, wherein, as mentioned above, the left-to-right direction is referred to as "transverse", and the down-to-up direction is as "anterior-posterior direction", and FIG. 3, the centrifugal governor 21 is provided with a cylinder block 22 in which a cylinder 41 is transversely arranged and a crankshaft 25 is arranged in the anterior-posterior direction, or in a plane perpendicular to the crank. A gear case 27 is provided in front of the cylinder block 22 housing a fuel pump 1 located near the cylinder 41, and a governor weight 6 located near the crankshaft 25. A governor lever 3, preferably of letter-T, is provided between the weight 6 and the fuel pump 1. The governor lever 3 includes a weight-side lever 31, a spring-side lever 32, and a pivot 33 about which the lever 3 rotates in a horizontal plane.

A spring supporter 42 extends in the anterior-posterior direction from a middle part of the governor lever 3. A speed-adjusting lever 35 is provided nearer the pump 1 than the spring supporter 42, in such a manner that the lever 35 can rotate in a horizontal plane. A main spring 4 constituted as a tension-coiled spring is provided between the speed-adjusting lever 35 and the spring supporter 42. Another spring called "idling spring" 5 is fixed to that portion 3*a* of weight-side lever 31 that is nearer to the pump 1 than the pivot 33, and to the front wall 27*a* of the gear case 27.

The fuel pump 1 is provided with a fuel adjuster 2 which is linked to the speed-adjusting lever 35 through the weight-side lever 31, a torque-up device 34 (torque-increasing device), the spring-side lever 32, and the main spring 4 in series.

Under the above-mentioned structure the fuel adjuster 2 is spring-biased by the governor lever 3 in the R direction; that is, to increase the supply of fuel to the engine by the synthetic tensile force (STF) of the tensile force (GS) of the main spring 4 and the tensile force (IS) of the idling spring 5, and is spring-biased by the governor force (GF): of the governor weight 6 in the direction of L; that is, to decrease the supply of fuel to the engine.

If any disequilibrium occurs between the synthetic tensile force (STF) and the governor force (GF), the fuel adjuster 2 is shifted in the L direction; that is, to decrease the supply of fuel.

In a modified embodiment the idling spring 5 spring-biases the governor lever 3 in the direction of increasing the supply of fuel in the middle low-load set (LML), and negates the spring-biasing in the middle high-load set (LMH).

In another modified embodiment the idling spring 5 is constituted as a tension coiled spring having a hook 7 engaged with a slot 8 produced in the governor lever 3 in such a manner that the hook 7 is slidable in the slot 8 in the direction in which the supply of fuel is increased.

In a further modified embodiment the idling spring 5 is constituted as a tension coiled spring having a hook 9 engaged with a pin 10 erected on the governor lever 3 in such a manner that the hook 7 is slidable along the pin 10 in either of the directions in which the supply of fuel is increased or decreased.

Referring to FIGS. 1A to 1D and FIGS. 5A to 5D, the principle underlying the present invention will be described:

As shown in FIG. 1D, the tensile force (IS) of the idling spring 5 used in the present invention varies in the non-load set (014) and the low-load set (LL) in the same manner as the conventional idling spring does, but the tensile force (IS) is negated in the high-load set (LH) and the full-load set (4/4) in contrast to the conventional idling spring where its tensile force varies even in these sets. Under the present invention the tensile force variation rate (θ1) remains constant in the low-load set (LL) but the tensile force variation width diminishes from (ISF1) to (ISF).

These tensile force variation rates are graphically illustrated in FIG. 5B, from which it will be understood that in the present invention the synthesized tensile force (STF) of the tensile force (IS) of the idling spring 5 and the tensile force (GS) of the main spring 4 varies more gradually in the high-load set (LH) than the low-load set (LL).

If the synthesized tensile force variation rate (STF) shown in FIG. 5B, and the variation rate of the governor force (GF) of the governor weight 6 against the running speed (N) of the engine are brought into equilibrium, the governor characteristics (QNG) effective for performing the load-based speed control is obtained, as shown in FIG. 5D.

As shown in FIG. 5D, the governor characteristics (QNG) obtained under the present invention is advantageous over the conventional centrifugal governor in the following at least two points:

(1) In the non-load set (0/4) and the low-load set (LL) the centrifugal governor of the present invention keeps the rated engine speed variation constant, thereby ensuring a stable engine speed.

(2) In the high-load set (LH) and the full load set (4/4) the centrifugal governor of the present invention minimizes the rated running speed variation, and ensures that the accelerated rising speed accelerates when a load is stepped up. The rated running speed variation δ 1 is defined as follows:

When a load has settled down after it was subjected to change, the post-change running speed (ns) varies against the pre-change running speed (nr) in accordance with the governor characteristics. This can be expressed by the following equation:

$$\delta 1=\{(ns-nr)/nr\}\times 100(\%)$$

The advantages (1) and (2) pointed out above can be equally achieved, not one or the other like the conventional centrifugal governor. This merit of the double advantageous functions is achieved merely by preventing the idling spring 5 from changing its tensile force in the high-load set (LH) and the full load set (4/4), thereby eliminating the necessity of preparing a complicated, expensive device. The durability of the centrifugal governor is enhanced because of its structural simplicity.

What is claimed is:

1. A centrifugal governor for being incorporated in the horizontal diesel engines, comprising:

a cylinder block including a cylinder transversely arranged and a crankshaft arranged perpendicular thereto;

a gear case provided in front of the cylinder block;

a fuel pump housed in the gear case toward the cylinder, the fuel pump including a fuel adjuster;

a governor weight located toward the crankshaft;

a governor lever provided between the governor weight and the fuel pump, wherein the governor lever is pivoted to a pivot in such a manner as to rotate in a horizontal plane;

a spring supporter extending from a middle part of the governor lever;

a speed-adjusting lever provided nearer the fuel pump than the spring supporter, in such a manner as to enable the lever to rotate in a horizontal plane;

a main spring fixed to the speed-adjusting lever at one end and to the spring supporter at the other end; and an idling spring fixed to the governor lever at one end, and to the front wall of the gear case at the other end;

wherein the governor lever, when operated, applies a synthesized tensile force (STF) of the tensile forces (GS) of the main spring 4 and the tensile force (IS) of the idling spring to the fuel adjuster of the fuel pump so as to increase the supply of fuel, and cause the governor weight to decrease the fuel amount by pushing down the fuel adjuster, so that a disequilibrium between the synthetic tensile force (STF) of the two springs and the governor force (GF) is utilized for increasing or decreasing the supply of fuel through the operation of the fuel adjuster;

wherein the idling spring is constituted as a tension coiled spring;

wherein the idling spring spring-biases the governor lever in the direction of increasing supply of the fuel both in the non-load set and in the low-load set (LL), and negates the spring-biasing both in the high-load set (LH) and in the full-load set.

2. The centrifugal governor of claim 1, wherein the idle-spring supporter extends backward from a middle part of the governor lever in the form of letter-T, and wherein the speed-adjusting lever is positioned nearer the fuel pump than the spring supporter in a horizontally rotative manner to support the main spring.

3. The centrifugal governor of claim 1, wherein the governor lever comprises a first lever toward the weight, and a second lever toward the main spring, both lever being pivotally supported by the pivot;

wherein the fuel-adjuster is connected to the speed-adjusting lever through the first lever, a torque-up device, the second lever, and the main spring;

wherein the first lever is connected to the idle-spring and the governor weight.

4. The centrifugal governor of claim 1, wherein the idling spring spring-biases the governor lever in the direction of increasing the supply of fuel in the middle low load (LML), and negates the spring-biasing in the middle high-load set (LMH).

5. The centrifugal governor of claim 1, wherein the idling spring is constituted as a tension coiled spring having a hook engaged with a slot produced in the governor lever in such a manner that the hook is slidable in the slot in a direction in which the supply of fuel is increased.

6. The centrifugal governor of claim 1, wherein the idling spring is constituted as a tension coiled spring having a hook engaged with a pin erected on the governor lever in such a manner that the hook is slidable along the pin in either of the directions in which the supply of fuel is increased or decreased.

* * * * *